US008997825B1

(12) United States Patent
Caldwell

(10) Patent No.: US 8,997,825 B1
(45) Date of Patent: Apr. 7, 2015

(54) ROLL-UP DOOR GUARD

(76) Inventor: Randy Caldwell, Cadiz, KY (US)

( * ) Notice: Subject to any disclaimer, the term of this patent is extended or adjusted under 35 U.S.C. 154(b) by 38 days.

(21) Appl. No.: 13/603,963

(22) Filed: Sep. 5, 2012

(51) Int. Cl.
*E06B 9/17* (2006.01)
*E06B 9/15* (2006.01)

(52) U.S. Cl.
CPC ..... *E06B 9/15* (2013.01)

(58) Field of Classification Search
CPC ..... E06B 9/15; E06B 9/165; E06B 9/34; E06B 9/58; E06B 9/581
USPC ..... 160/23.1, 133; 248/254; 242/615; 211/105.1
See application file for complete search history.

(56) References Cited

U.S. PATENT DOCUMENTS 2,778,030 A * 1/1957 Goche ..... 4/608
6,659,158 B2 * 12/2003 Laugenbach ..... 160/270
7,798,198 B2 * 9/2010 Rejc et al. ..... 160/133

* cited by examiner

*Primary Examiner* — Blair M Johnson
(74) *Attorney, Agent, or Firm* — Middleton Reutlinger

(57) ABSTRACT

A roll-up door guard assembly includes a first guard mount and a second guard mount capable of being mounted at ends of a roll-up door, a bar extending between the first guard mount and the second guard mount, the roll up door disposed between the bar and a wall to which said roll-up door is connected, the guard mounts connected to one of a wall and the roll-up door.

19 Claims, 5 Drawing Sheets

ROLL-UP DOOR GUARD

BACKGROUND

Present embodiments relate to a roll-up door. More specifically, present embodiments relate to a guard for a roll-up door which inhibits damage to the door or door shroud from objects passing through the doorway, such as fork lifts for example.

Roll-up doors are utilized for a variety of functions. One usage is to allow passage through firewall openings within a building or warehouse. The roll-up door is opened during most usage but is lowered during fire conditions to inhibit spread of or contain a fire.

However, during operation of a warehouse, for example, forklifts and hand trucks are used on a regular basis and pass through these openings in the firewall. Often the forks of the forklifts for example are in a raised condition when the vehicle is moving. During passage through openings, the forks, the load or otherwise elevated structure can impact the door or door shroud of the roll-up door assembly. This has two results. First, the shroud may be damaged, which may result in the roll-up door being inoperable. Second, if the impact is severe enough, the door may be damaged as well as the shroud. This will also adversely impact door operation.

In either instance, the damage to the shroud or the door and shroud may preclude use of the door which presents an undesirable fire hazard. Specifically, the door cannot be closed in a fire condition which, as a result, allows the spread of fire through the building housing the roll-up door.

As may be seen by the foregoing, there is a need to provide a structure for inhibiting damage to the door shroud and the roll-up door from equipment passing through the doorway.

SUMMARY

According to some embodiment, a roll-up door guard assembly comprises a first guard mount for positioning adjacent a first end of a roll-up door assembly and a second guard mount for positioning along a second end of said roll-up door assembly, a sleeve mounted to each of the first guard mount and the second guard mount, a bar extending between the first sleeve and the second sleeve, the bar capable of being positioned forward of the roll-up door assembly. The roll-up door guard assembly wherein the sleeves are formed to receive the bar. The roll-up door guard assembly wherein the sleeves are formed to be received by the bar. The roll-up door guard assembly wherein the sleeves are removably connected to the first and second guard mounts. The roll-up door guard assembly wherein the sleeves are integrally connected to the first and second guard mounts. The roll-up door guard assembly wherein the roll-up door guard is configured for connection to said roll-up door assembly. The roll-up door guard assembly wherein the roll-up door guard is configured for connection to a wall adjacent the door cover assembly. The roll-up door guard assembly wherein the bar is of a length equal to a distance between the first guard mount and the second guard mount. The roll up door guard assembly wherein the bar is welded to the first guard mount and said second guard mount. The roll-up door guard assembly wherein said bar is welded to the first sleeve and the second sleeve. The roll-up door guard assembly wherein the bar is of a length greater than a distance between the first sleeve and the second sleeve. The roll-up door guard assembly wherein the bar is captured between the first sleeve and the second sleeve. The roll-up door guard assembly further comprising a set screw connecting the bar to the first and second sleeves. The roll-up door guard assembly wherein the sleeves and the bar are square-shaped in cross-section.

According to some other embodiments, a roll-up door guard assembly comprises a bar extending between a first sleeve and a second sleeve, a first guard mount at a first end of the bar and a second guard mount at a second end of the bar, the first sleeve extends from the first guard mount and the second sleeve extends from the second guard mount, the first and second guard mounts being connectable to a roll-up door assembly. The roll-up door guard assembly wherein the bar is hollow. The roll-up door guard assembly wherein the bar is disposed adjacent a storage area for a roll up door. The roll-up door guard assembly wherein the first sleeve and the second sleeve are L-shaped. The roll-up door guard assembly may be U-shaped.

According to still other embodiments, a roll-up door guard assembly, comprises a first guard mount and a second guard mount capable of being mounted at ends of a roll-up door, a bar extending between the first guard mount and the second guard mount, the roll up door disposed between the bar and a wall to which the roll-up door is connected, the guard mounts connected to one of a wall and said roll-up door. The roll-up door guard assembly wherein the guard mount further comprises a sleeve. The roll-up door guard assembly wherein the bar is one of removably or fixedly connected to the sleeve.

All of the above outlined features are to be understood as exemplary only and many more features and objectives of the roll-up door guard assembly may be gleaned from the disclosure herein. Therefore, no limiting interpretation of this summary is to be understood without further reading of the entire specification, claims, and drawings included herewith.

BRIEF DESCRIPTION OF THE ILLUSTRATIONS

The above-mentioned and other features and advantages of this disclosure, and the manner of attaining them, will become more apparent and the roll-up door guard will be better understood by reference to the following description of embodiments taken in conjunction with the accompanying drawings, wherein.

DETAILED DESCRIPTION

Figure 1:
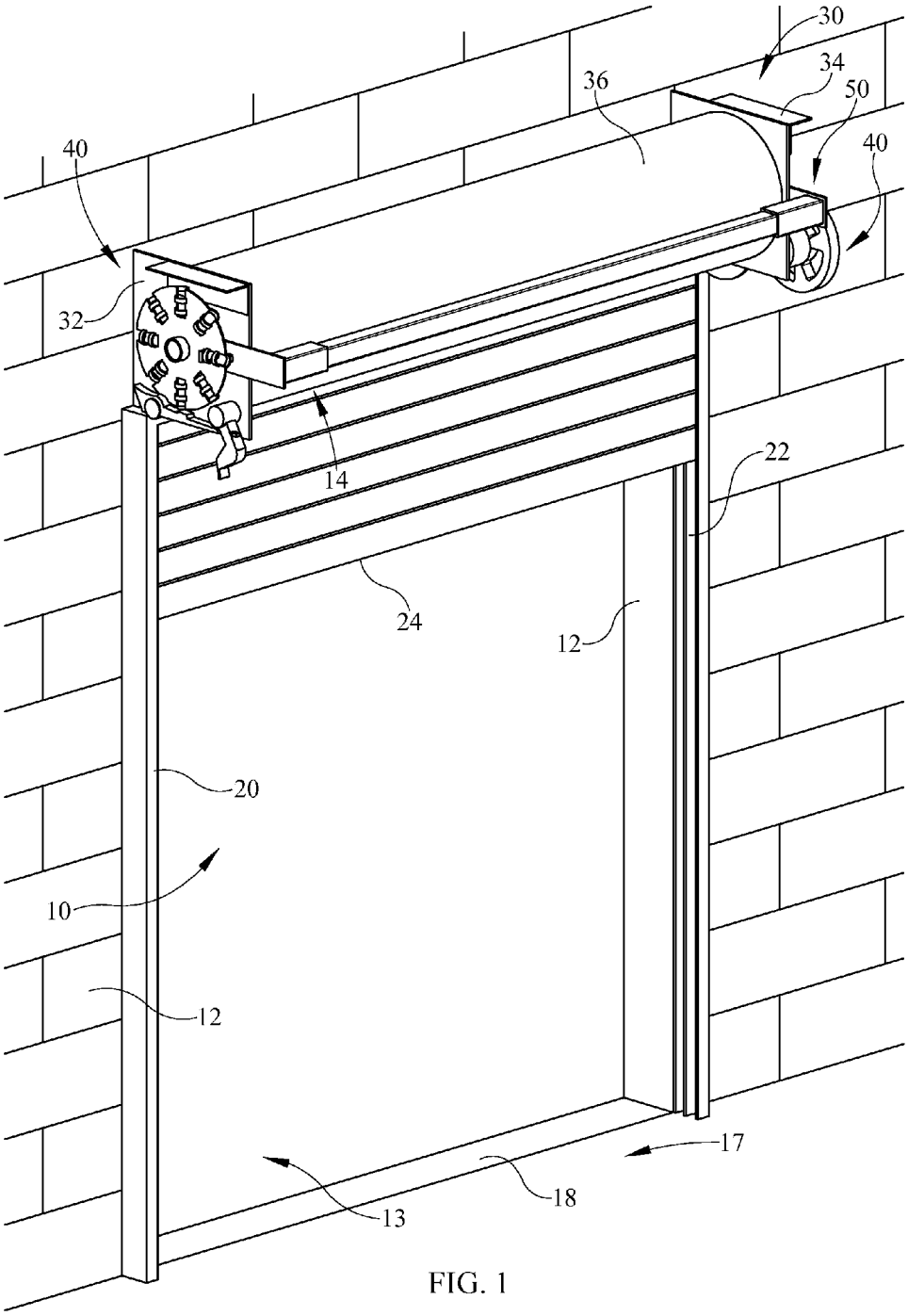
FIG. 1 is an isometric view of the roll-up door at the doorway and a roll up door guard assembly.

Reference now will be made in detail to embodiments provided, one or more examples of which are illustrated in the drawings. Each example is provided by way of explanation, not limitation of the disclosed embodiments. In fact, it will be apparent to those skilled in the art that various modifications and variations can be made in the present embodiments without departing from the scope or spirit of the disclosure. For instance, features illustrated or described as part of one embodiment can be used with another embodiment to still yield further embodiments. Thus it is intended that the present invention covers such modifications and variations as come within the scope of the appended claims and their equivalents.

Referring now to FIGS. 1-5, a roll-up door guard assembly is depicted in various embodiments. The roll-up door guard assembly allows for positioning adjacent to a rollup door assembly such that when the roll-up door is in the up position allowing passage through the doorway, vehicles loading equipment or loads having a substantial height cannot directly contact the roll-up door assembly and cause damage to the door or shroud. Instead the guard receives the contact and precludes damage to the roll-up door which would otherwise occur without the door assembly.

Referring now to FIG. 1, a doorway 10 is depicted defined by a wall 12 having an opening 13 and a header 14 extending above the opening 13. The doorway 10 has a first track 20 in a second track 22 adjacent the wall 12 along the opening 13 and extending vertically to guide roll up or down of a door 24. A floor 16 is depicted below the header 14 and a threshold 18 is defined between the walls 12 and across the opening 13 wherein the door 24 may be seated when in the closed position. The door 24 is shown partly open, merely for illustration. One skilled in the art will understand that the door 24 will likely be in the fully open position when traffic, such as moving machinery is passing therethrough. In case of a fire, the door is closed to inhibit spread of fire through the building.

Above the doorway 10 is a roll-up door assembly 30. The door assembly 30 comprises a first door bracket 32 and a second door bracket 34 which provide two functions. First the brackets 32, 34 allow connection of the roll-up assembly 30 to the wall 12. Second, the brackets allow for rotation of the assembly allowing the door 24 to move up and down for opening and closing. The roll-up door assembly 30 further includes a door shroud cover 36 wherein the door 24 is housed when in the up or open position. The roll up door assembly 30 includes a pivot assembly 40 at each end of the assembly 30 which allows rotation of the door 24 during the roll up or roll down function to open or close the doorway 10. The pivot assembly 40 may include a biasing structure which is not shown for clarity purpose but may include, for example, a coil or torsion spring to aid in lifting or lowering the door and controlling the weight thereof.

Positioned in front of the door assembly 30 is a door guard assembly 50. The guard assembly 50 is positioned in front of the roll up door assembly 30 in order to inhibit machines from damaging the door assembly 30 when passing through the doorway 10. In use within a warehouse, or manufacturing facility, forklifts or other load movers tend to utilize structure which is moveable through a range of heights. As such mover or loading equipment raises the load or equipment, the may exceed the maximum height allowed for clearance by the roll-up door assembly 30. When this occurs and the driver does not correct the situation, the equipment will strike the roll-up door assembly 30. The result is that at a minimum that the cover 36 is dented. More typically though, the cover is damaged inhibiting operation of the door 24 or the strike is so severe as to damage the door 24 in addition to the cover 36.

The guard assembly 50 is positioned forward of the roll up door assembly 30 in order to protect from such damage. The guard assembly 50 receives the impact from the moving equipment passing through the doorway 10 rather than the roll-up door assembly 30. This guard assembly 50 therefore will reduce repair and replacement costs for door assemblies 30 and related components.

Figure 2:
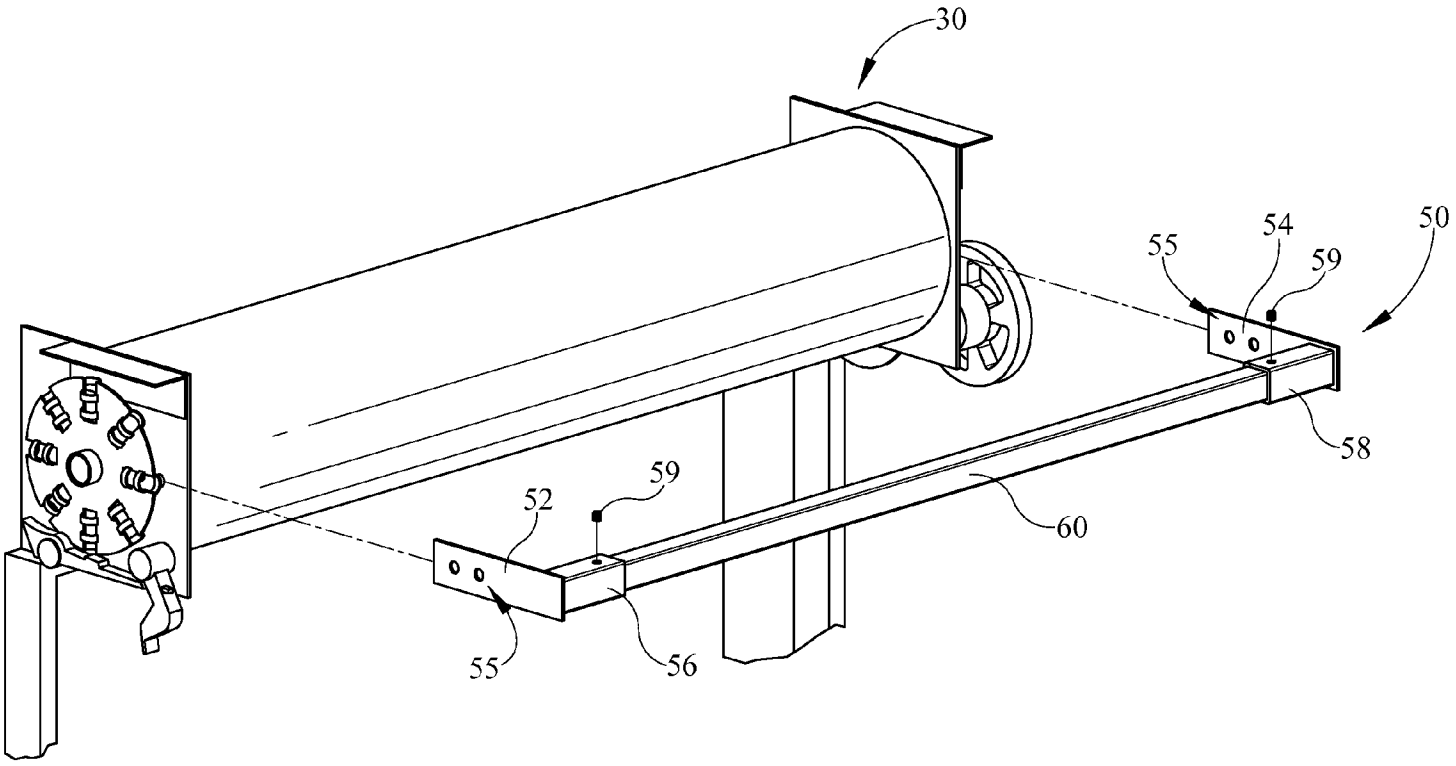
FIG. 2 is an isometric view of the roll-up door with the guard assembly exploded away.

Referring now to FIG. 2, an exploded view of the rollup door assembly 30 and the guard assembly 50 is depicted in isometric view. The guard assembly 50 includes a first mounting member 52 and a second mounting member 54 position for mounting at axial ends of the roll-up door assembly 30.

Each of the mounting members 52, 54 have a first end which is mounted toward the wall 12 wherein the doorway 10 is positioned and a second end spaced away from the first end. The mounting members 52, 54 may be of various shapes and may be formed of steel or other fire rated high strength materials which allow for mounting in a variety of ways. The mounting members 52, 54 are shown as generally rectangular in shape, however the members 52, 54 may vary in shape and may alternatively be formed of various materials.

Connected to the first and second mounting members 52, 54 are sleeves 56, 58. Each sleeve 56, 58 has a first end spaced toward the corresponding mounting member 52, 54 and a second end spaced away from the mounting member. The exemplary sleeves 56, 58 in combination with the mounting member 52, 54 form an L-shaped structure. However, such description should not be considered limiting, but instead merely exemplary. The sleeve 56 is shown with a square cross-section of may be any of various shapes which may or may not correspond to a bar structure 60 which, discussed further here in. According to some exemplary embodiments, the sleeve 56, 58 is shown as receiving the bar 60 and therefore is at least partially hollow in shape. Alternatively, the sleeves 56, 58 may be sized and configured so that the bar 60 receives the sleeves 56, 58 opposite to the depicted embodiment. The combination of the mounting number 52, 54 and each sleeve 56, 58 forms an L-shaped according to the instant embodiment. However various configurations may be formed with this configuration. Additionally, the sleeves 56 and 58 may be permanently connected to mounting members such as by welding or integrally forming such as by molding or cast forms. In a further embodiment, the sleeves 56, 58 may be removably attached to the mounting number 52, 54 effectively. For example, a set screw 59 may be used retain bar 60 within sleeves 56,58.

Figure 3:
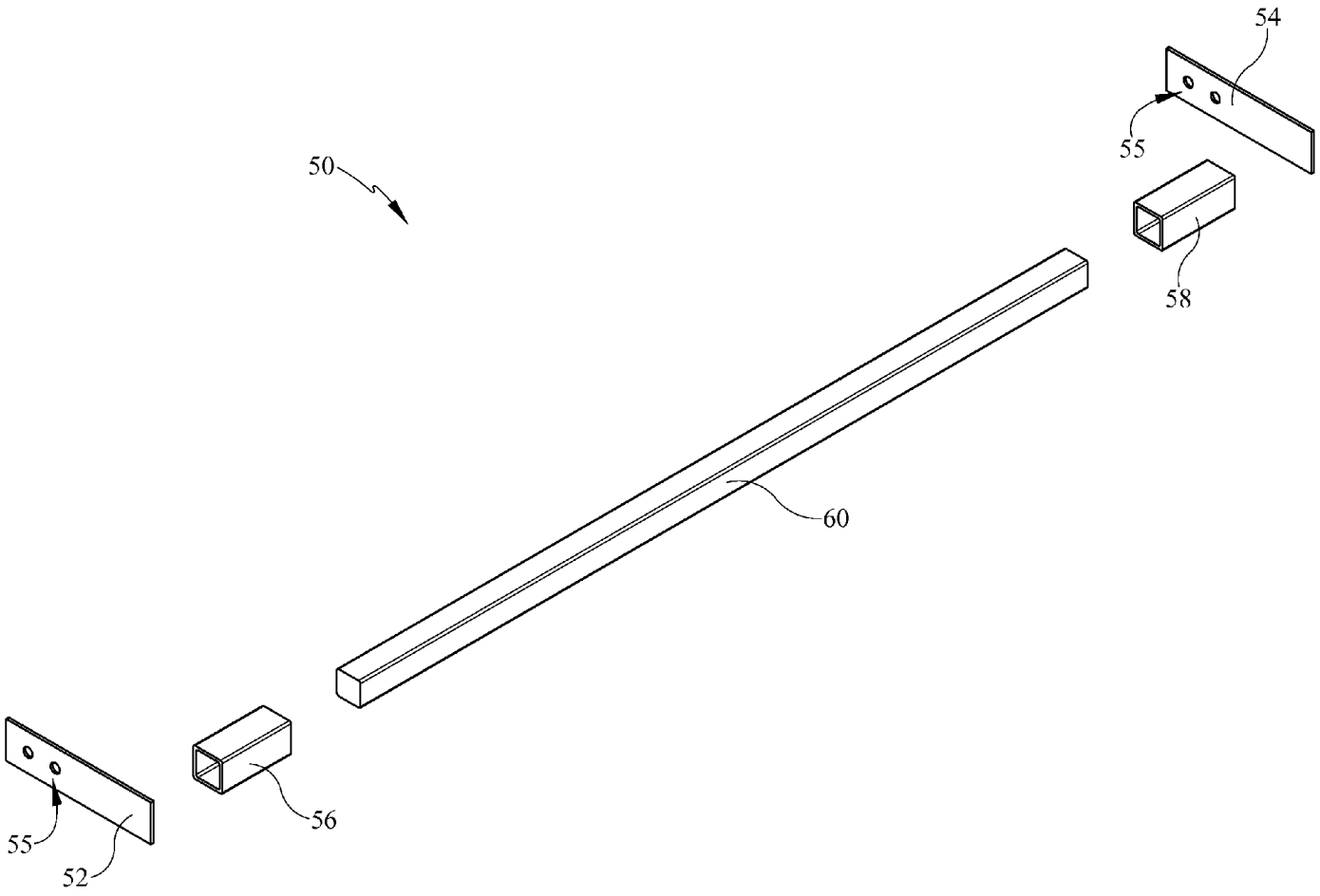
FIG. 3 is an isometric view of an exemplary roll-up door guard assembly.

Referring now to FIG. 3, an exploded view of the sleeves 56, 58 and bar 60. The sleeves 56, 58 receive the bar 60 at hollow ends of the sleeve 56, 58. As described previously, various shapes may be sued to form the sleeves 56, 58 and the corresponding shape of the bar 60. For example, circular bar stock may be used instead of the square bar. Additionally, the bar 60 may be hollow or may be solid. Weight requirements related to mounting as well as the width or span of the doorway 10 may dictate the type of bar 60 used and the size of sleeves 56, 58. According to some embodiments the bar 60 may be formed hollow and large enough to receive the sleeves 56, 58.

Figure 4:
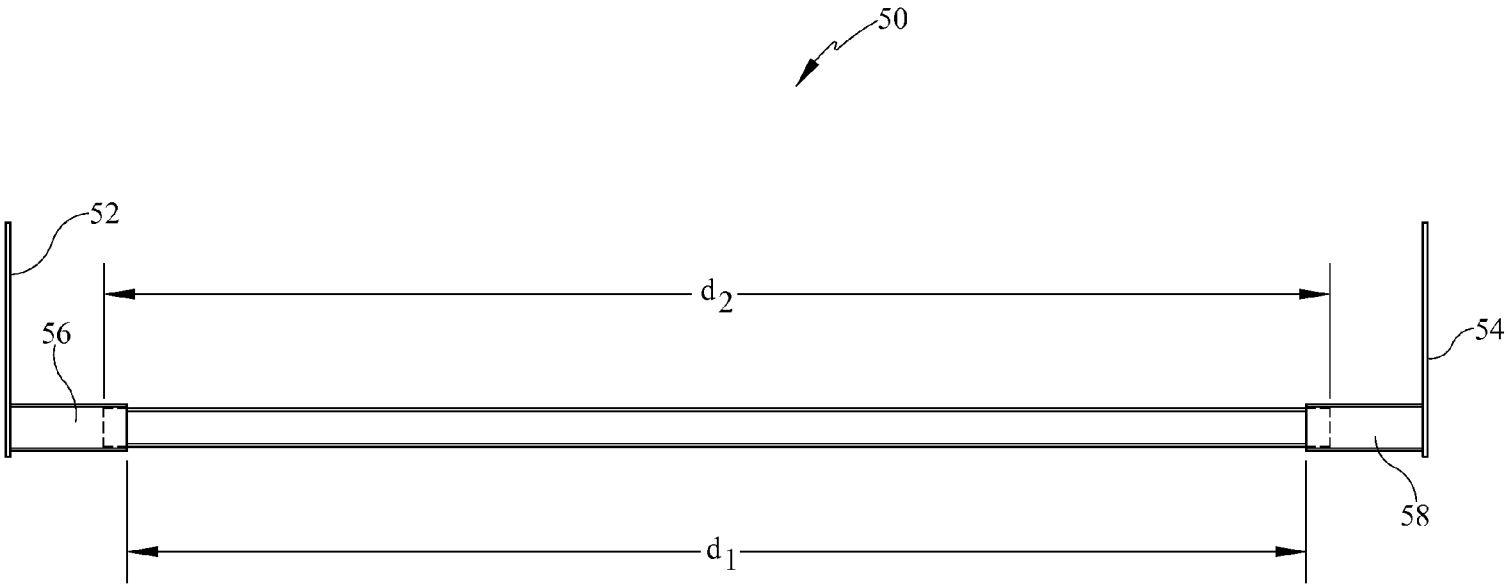
FIG. 4 is a top view of an exemplary door guard assembly.

Referring now to FIG. 4, a top view of the guard assembly 50 is shown in the assembled configuration. According to one embodiment, the sleeves 56, 58 are spaced apart a distance $d_1$. The bar 60 is accordingly cut to a length $d_2$ which is either equal to or greater than the distance $d_1$. The receiving ends of the sleeves 56, 58 may be spaced apart a distance $d_1$. The bar 60 is cut to a length equal to $d_1$ wherein the bar is welded to the sleeves 56, 58. In an alternative, the bar 60 is a length $d_2$ that is greater than the distance $d_1$. In this embodiment, the bar 60 may be slidably positioned within the sleeves 56, 58 or may be positioned exteriorly thereof. As shown in the depicted embodiment, the broken lines within the sleeves 56, 58 show the oversized bar length. In this embodiment, the oversized length of the bar 60 results in capture of the bar 60 so that it cannot be removed when the mounting members 52, 54 are fixedly mounted. In addition, for example, the bar 60 may or may not additionally be welded to the sleeves 56, 58. Alternatively, the bar may be locked by a set screw passing through sleeves 56,58.

Additionally shown in FIG. 4, along the mounting members 52, 54 are flanges 53 which may be used to connected the mounting members 52, 54 to the roll-up door assembly 30. The flange 53 may be positioned at any location along the members 52, 54. In the alternative, a fastener aperture 55

(FIG. 2) may be disposed in the members 52, 54. This will allow for multiple mounting options to accommodate for various roll-up door assemblies.

Figure 5:
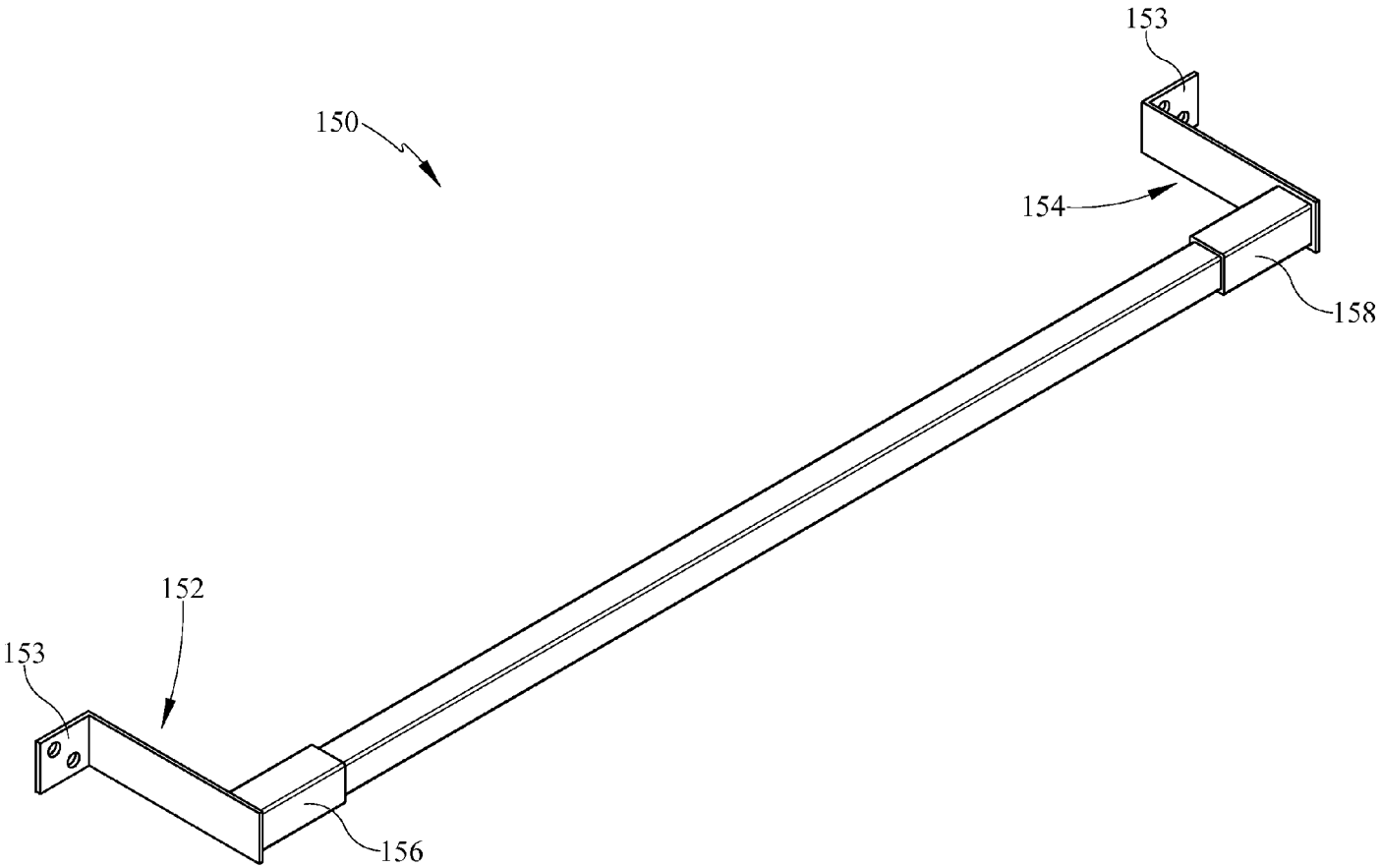
FIG. 5 is an alternate embodiment of a door guard assembly.

As shown in FIG. 5, alternative mounting members 152, 154 are shown. In this embodiment, flanges 53 are disposed at ends of the members in order to allow mounting of the members to a wall. This embodiment is used to connected the guard to a wall as opposed to or in addition to the roll-up door assembly.

While multiple inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the invent of embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Examples are used to disclose the embodiments, including the best mode, and also to enable any person skilled in the art to practice the apparatus and/or method, including making and using any devices or systems and performing any incorporated methods. These examples are not intended to be exhaustive or to limit the disclosure to the precise steps and/or forms disclosed, and many modifications and variations are possible in light of the above teaching. Features described herein may be combined in any combination. Steps of a method described herein may be performed in any sequence that is physically possible.

All definitions, as defined and used herein, should be understood to control over dictionary definitions, definitions in documents incorporated by reference, and/or ordinary meanings of the defined terms. The indefinite articles "a" and "an," as used herein in the specification and in the claims, unless clearly indicated to the contrary, should be understood to mean "at least one." The phrase "and/or," as used herein in the specification and in the claims, should be understood to mean "either or both" of the elements so conjoined, i.e., elements that are conjunctively present in some cases and disjunctively present in other cases.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What I claim is:

1. A roll-up door assembly and door guard assembly, comprising:

a door guard assembly comprising a first guard mount positioned at a first end of a roll-up door assembly and a second guard mount positioned at a second end of said roll-up door assembly, a sleeve mounted to each of said first guard mount and said second guard mount and forward of said roll-up door assembly and a bar extending between said first sleeve and said second sleeve;

said roll up door assembly comprising a first door bracket and a second door bracket which directly support a roll up door, said first guard mount and said second guard mount extending from said first bracket and said second bracket, respectively;

said first guard mount and said second guard mount extending forward of said roll-up door assembly;

said bar, said first guard mount and said second guard mount disposed above an opening in a wall, said opening extending to a floor and defining a doorway;

said bar being positioned forward of said roll-up door assembly.

2. The roll-up door guard assembly of claim 1 wherein said sleeves receive said bar.

3. The roll-up door guard assembly of claim 1 wherein said sleeves are received by said bar.

4. The roll-up door guard assembly of claim 1 wherein said sleeves are removably connected to said first and second guard mounts.

5. The roll-up door guard assembly of claim 1 wherein said sleeves are integrally connected to said first and second guard mounts.

6. The roll-up door guard assembly of claim 1 wherein said roll-up door guard is configured for connection to a wall adjacent said roll-up door.

7. The roll-up door guard assembly of claim 1 wherein said bar is of a length equal to a distance between said first sleeve and said second sleeve.

8. The roll up door guard assembly of claim 1 wherein said bar is welded to said first sleeve and said second sleeve.

9. The roll-up door guard assembly of claim 1 wherein said bar is of a length greater than a distance between said first sleeve and said second sleeve.

10. The roll-up door guard assembly of claim 9 wherein said bar is captured between said first sleeve and said second sleeve.

11. The roll-up door guard assembly of claim 1 wherein said sleeves and said bar are square-shaped in cross-section.

12. A roll-up door assembly and door guard assembly, comprising:

a door guard assembly comprising a bar extending between a first sleeve and a second sleeve, a first guard mount at a first end of said bar and a second guard mount at a second end of said bar;

a roll-up door assembly, wherein said first and second guard mounts extend from first and second door brackets of said roll-up door assembly, said first and second door brackets directly supporting a roll-up door;

said first and second guard mounts extending away from a doorway beneath said roll-up door assembly;

said first sleeve extending from said first guard mount and said second sleeve extending from said second guard mount;

said first and second guard mounts being connected to said roll-up door assembly.

13. The roll-up door guard assembly of claim 12 wherein said bar is hollow.

14. The roll-up door guard assembly of claim 12 wherein said bar is disposed adjacent a storage area for a roll up door.

15. The roll-up door guard assembly of claim 12 being U-shaped.

16. A roll-up door and door guard assembly, comprising:

a door guard assembly comprising a first guard mount and a second guard mount mounted above a doorway at ends of a roll-up door and extending to a position forward of said roll-up door, a bar extending between said first guard mount and said second guard mount at said position forward of said roll-up door;

said roll-up door directly supported by a first door bracket and a second door bracket, from which said first and second guard mounts extend, respectively;

said roll up door disposed between said bar and a wall to which said roll-up door is connected.

17. The roll-up door guard assembly of claim 16, said guard mount further comprising a sleeve.

18. The roll-up door guard assembly of claim 17, said bar is one of removably or fixedly connected to said sleeve.

19. The roll-up door guard assembly of claim 17, said bar being welded to said first guard mount and said second guard mount.

* * * * *